US008425023B2

(12) United States Patent
Teramae

(10) Patent No.: US 8,425,023 B2
(45) Date of Patent: Apr. 23, 2013

(54) LIQUID EJECTING APPARATUS

(75) Inventor: Hirofumi Teramae, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 278 days.

(21) Appl. No.: 12/889,226

(22) Filed: Sep. 23, 2010

(65) Prior Publication Data

US 2011/0080443 A1 Apr. 7, 2011

(30) Foreign Application Priority Data

Oct. 1, 2009 (JP) ..... 2009-229301

(51) Int. Cl.
*B41J 2/19* (2006.01)
*B41J 29/38* (2006.01)

(52) U.S. Cl.
USPC ..... 347/92; 347/10; 347/14

(58) Field of Classification Search ..... None
See application file for complete search history.

(56) References Cited

U.S. PATENT DOCUMENTS

| | | | | |
|---|---|---|---|---|
| 5,231,424 | A | 7/1993 | Kaneko et al. | |
| 6,491,370 | B2 | 12/2002 | Momose | |
| 7,992,981 | B2 | 8/2011 | Yokouchi | |
| 8,109,588 | B2 | 2/2012 | Ozawa et al. | |
| 2009/0079773 | A1 | 3/2009 | Hosono et al. | |
| 2009/0147053 | A1 | 6/2009 | Yokouchi | |
| 2009/0295853 | A1* | 12/2009 | Hosono et al. | 347/10 |
| 2012/0081468 | A1 | 4/2012 | Ozawa et al. | |

FOREIGN PATENT DOCUMENTS

| | | |
|---|---|---|
| CN | 101456291 | 6/2009 |
| CN | 101544110 | 9/2009 |
| EP | 2039515 | 3/2009 |
| JP | 04-211962 | 8/1992 |
| JP | 07-186402 | 7/1995 |
| JP | 2001-353884 | 12/2001 |
| JP | 2009-073074 | 4/2009 |
| JP | 2009-148928 | 7/2009 |

* cited by examiner

*Primary Examiner* — Geoffrey Mruk
(74) *Attorney, Agent, or Firm* — Workman Nydegger

(57) ABSTRACT

A liquid ejecting apparatus includes a liquid ejecting head, a driving signal generating section, a drive control section, and a sealing section. The liquid ejecting head includes a continuous liquid path and a pressure generating section. The liquid path contains a pressure space and a nozzle opening. The driving signal generating section generates a driving signal containing a driving pulse that drives the pressure generating section. The driving pulse includes a first pulse for causing discharge of droplets and a second pulse that is generated to the pressure generating section at a generation interval T set in a range represented by the following expression: $(n-1/4)Tc<T<(n+1/4)Tc$, where Tc is a natural oscillation period of the liquid within the pressure space. The sealing section seals the nozzle opening of the liquid ejecting head when the pressure generating section is driven by the second pulse.

5 Claims, 9 Drawing Sheets

LIQUID EJECTING APPARATUS

The entire disclosure of Japanese Patent Application No. 2009-229301 filed Oct. 1, 2009 is expressly incorporated by reference herein.

BACKGROUND

1. Technical Field

The present invention relates to a liquid ejecting apparatus including a liquid ejecting head that ejects liquid through a nozzle opening, such as an ink jet recording head.

2. Related Art

One typical example of a liquid ejecting apparatus including a liquid ejecting head that discharges (ejects) droplets through a nozzle aperture by causing pressure fluctuations in liquid within a pressure generation chamber, the liquid ejecting apparatus being capable of discharging various kinds of liquid from this ejecting head, is an image recording apparatus that records information by ejecting ink and causing it to reach a recording sheet or other media as an ejecting target (recording medium), such as an ink jet recording apparatus (hereinafter a printer). In recent years, such a liquid ejecting apparatus has been applied in various kinds of manufacturing equipment, in addition to the above image recording apparatus. For example, in equipment for manufacturing a display, such as a liquid crystal display, plasma display, organic electroluminescent (EL) display, or field emission display (FED) (surface emitting display), the liquid ejecting apparatus is used as one for ejecting various kinds of liquid material, such as color material or material of an electrode, to a region where pixels are to be formed, a region where electrodes are to be formed, or other regions.

With the above recording head, failure, such as defective ink discharging, may originate from ink thickening and sticking caused by natural evaporation or pressure loss caused by accommodation of pressure fluctuations of bubbles entrained in ink.

To prevent such defective ink discharging, various maintenance processes are carried out. One example recording head capable of carrying out a maintenance process is the one configured to forcefully remove thickened ink or bubbles entrained in ink by providing pressure fluctuations (pressure changes) within a pressure generation chamber by driving a pressure generating element and discharging droplets through a nozzle aperture onto an ink receiver for receiving discharged ink without recording information on paper (hereinafter referred to as flushing) (see, for example, JP-A-2009-73074).

Unfortunately, with the above recording head, if pressure fluctuations provided to the pressure generation chamber by flushing are small, it is difficult to sufficiently expel bubbles, so there is a problem in that ink may be wasted. If a rapid pressure change is provided to the pressure generation chamber, a free surface (meniscus) of ink within a nozzle aperture after discharging of ink may be destroyed and bubbles may in turn be captured in the pressure generation chamber, and this may increase defective discharging.

SUMMARY

An advantage of some aspects of the invention is that it provides a liquid ejecting apparatus capable of improving performance of expelling bubbles entrained in a liquid channel.

A liquid ejecting apparatus according to an aspect of the invention includes a liquid ejecting head, a driving signal generating section, a drive control section, and a sealing section. The liquid ejecting head includes a continuous liquid path and a pressure generating section. The liquid path contains a pressure space and a nozzle opening. The pressure generating section causes pressure fluctuations to occur in liquid within the pressure space. The liquid ejecting head ejects droplets through the nozzle opening by driving the pressure generating section. The driving signal generating section is capable of generating a driving signal containing a driving pulse that drives the pressure generating section. The drive control section supplies the driving pulse contained in the driving signal generated by the driving signal generating section to the pressure generating section. The sealing section seals a nozzle-formed surface of the liquid ejecting head. The driving pulse includes a bubble removal driving pulse for use in removing bubbles in the liquid path, the bubble removal driving pulse being set so as to cause pressure fluctuations in the liquid within the pressure space that are larger than a discharge driving pulse for use in discharging droplets. The sealing section seals the nozzle opening of the liquid ejecting head when the pressure generating section is driven by the bubble removal driving pulse.

With the above configuration, the driving pulse is set so as to cause pressure fluctuations in the liquid within the pressure space that are larger than those caused by the discharge driving pulse for use in causing discharge of droplets and contains a bubble removal driving pulse for causing removal of bubbles in the liquid path, and the sealing section seals the nozzle opening of the liquid ejecting head when the pressure generating section is driven by the bubble removal driving pulse. Therefore, the pressure fluctuations in the pressure space caused by supply of the bubble removal driving pulse can be larger than those occurring when the nozzle opening is opened. This can enhance performance of expelling bubbles in the liquid path. In addition, because liquid is not discharged through the nozzle opening in supplying the bubble removal driving pulse, unnecessary ink consumption can be reduced.

For the above configuration, the bubble removal driving pulse may preferably be generated to the pressure generating section at a generation interval T set in a range represented by the following expression (1):

$$(n-1/4)Tc<T<(n+1/4)Tc \quad (1)$$

where Tc is a natural oscillation period of the liquid within the pressure space. n=1, 2, 3 . . . (a natural number).

With this configuration, the pressure fluctuations in the pressure space caused by the bubble removal driving pulse and the natural oscillation period within the pressure space can resonate with each other. This can further increase the pressure fluctuations within the pressure space. As a result, performance of expelling bubbles entrained in the liquid path can be enhanced.

For the above configuration, the liquid ejecting apparatus may preferably include a backflow restricting section disposed upstream from the pressure space in the liquid path, allowing the liquid to flow downstream, and restricting an upstream backflow of the liquid.

With this configuration, because the liquid ejecting apparatus includes the backflow restricting section disposed upstream from the pressure space in the liquid path, allowing the liquid to flow downstream, and restricting an upstream backflow of the liquid, escape of the pressure fluctuations within the pressure space caused by the bubble removal driving pulse upstream from the backflow restricting section can be restricted. This can further increase the pressure fluctuations within the pressure space, and performance of expelling bubbles entrained in the liquid path can be enhanced.

For the above configuration, the liquid ejecting apparatus may preferably include a flow selecting section disposed upstream from the pressure space in the liquid path and being capable of selecting flow or non-flow of the liquid and selecting a non-flow state when the pressure generating section is driven by the bubble removal driving pulse.

With this configuration, because the liquid ejecting apparatus includes the flow selecting section disposed upstream from the pressure space in the liquid path and being capable of selecting flow or non-flow of the liquid and selecting a non-flow state when the pressure generating section is driven by the bubble removal driving pulse, escape of the pressure fluctuations within the pressure space caused by the bubble removal driving pulse upstream from the flow selecting section can be restricted. This can further increase the pressure fluctuations within the pressure space, and performance of expelling bubbles entrained in the liquid path can be enhanced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Best mode for carrying out some aspects of the invention is described below with reference to the accompanying drawings. For the embodiments described below, various limitations are made as preferred concrete examples of some aspects of the invention. However, the scope of some aspects of the invention is not limited to these embodiments unless so specified in the description below. In the following, an example in which an ink jet recording apparatus illustrated in FIG. 1 (hereinafter abbreviated as a printer) is used as a liquid ejecting apparatus according to some aspects of the invention is illustrated.

Figure 1:
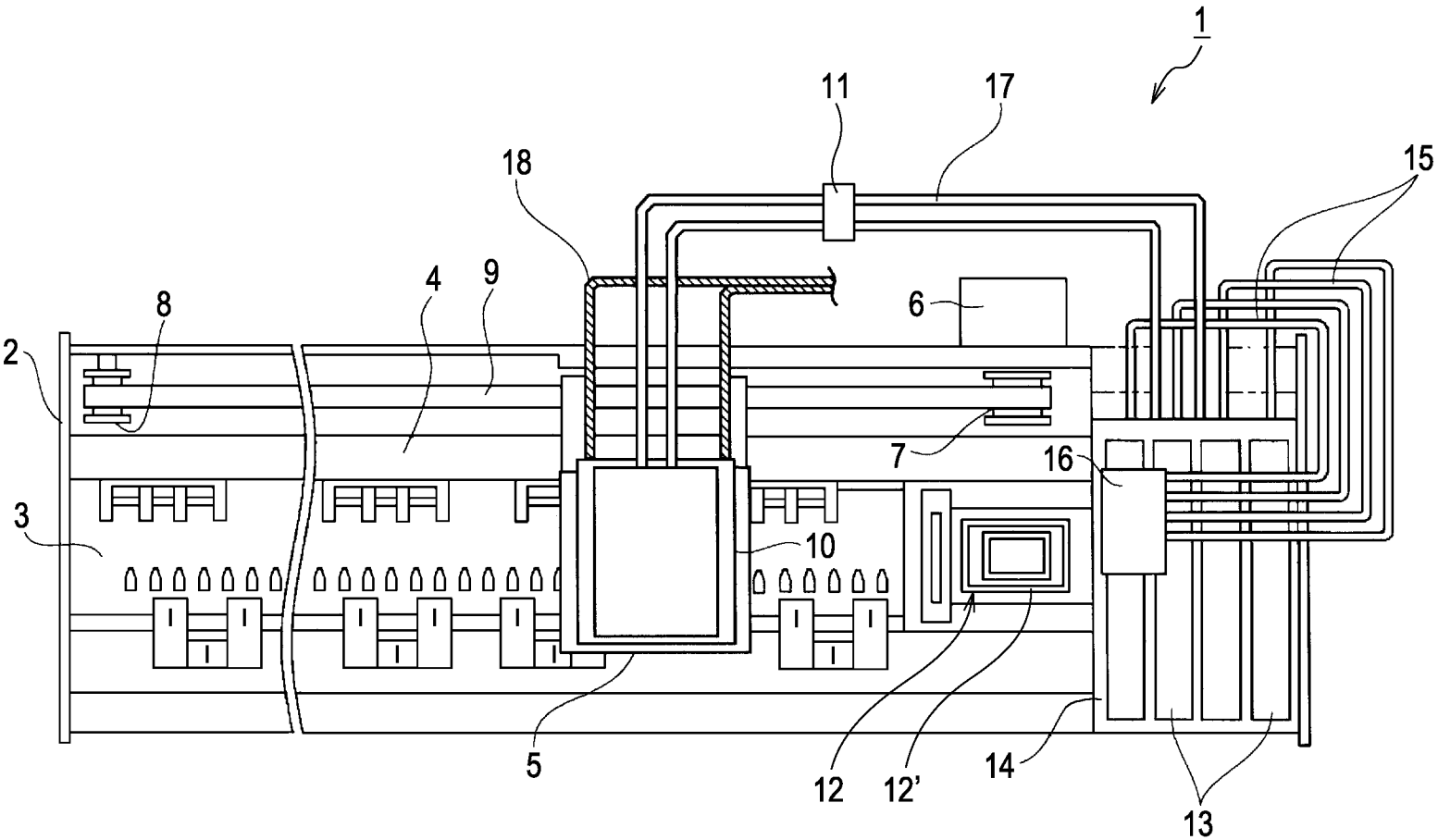
FIG. 1 is a plan view for describing a configuration of a printer.

FIG. 1 is a plan view that illustrates a configuration of a printer having a recording head being one kind of a liquid ejecting head. First, a general configuration of the printer having the recording head is described with reference to FIG. 1. An illustrated printer 1 is an apparatus that records an image or other information by discharging liquid ink droplets (corresponding to droplets according to some aspects of the invention) to a surface of a recording medium (a discharge target (not illustrated)), such as a recording sheet. The printer 1 includes a frame 2 and a platen 3 arranged in the frame 2. The platen 3 receives a recording sheet thereon transported by a rotating paper feed roller (not illustrated) driven by a paper feed motor (not illustrated). Inside the frame 2, a guide rod 4 is laid in substantially parallel with the platen 3. A slidable carriage 5 having a recording head 10 is supported on the guide rod 4. The carriage 5 is connected to a timing belt 9 disposed between a driving pulley 7 rotatable by being driven by a pulse motor 6 and an idling pulley 8 disposed opposite to the driving pulley 7 with respect to the frame 2. The carriage 5 is configured to be made to reciprocate along the guide rod 4 in a main scan direction which is substantially perpendicular to a paper feed direction by being driven by the pulse motor 6.

A cartridge holder 14 on which one or more ink cartridges 13 storing ink (one kind of liquid according to some aspects of the invention) are detachably mounted is disposed on a first side of the frame 2. Each of the ink cartridges 13 is connected to an air pump 16 with an air tube 15 disposed therebetween, and air is supplied from the air pump 16 into the ink cartridge 13. In response to pressure applied by the supplied air to the inside of the ink cartridge 13, ink is supplied (pumped) to the recording head 10 through an ink supply tube 17 (corresponding to part of a liquid path according to some aspects of the invention).

The ink supply tube 17 can be, for example, a flexible hollow member made of a synthetic resin, such as silicon. The ink supply tube 17 has an ink channel corresponding to each ink cartridge 13 formed therein. A check valve (self sealing valve) 11 (corresponding to a backflow restricting section according to some aspects of the invention) is arranged on the ink supply tube 17 between the ink cartridge 13 and the recording head 10, i.e., upstream from the recording head 10 on the ink supply tube 17. The check valve 11 allows ink to flow toward the recording head 10 through the ink channel of the ink supply tube 17 (downstream) and restricts backflow of ink toward the ink cartridge 13 (upstream). A flat flexible cable (FFC) 18 for use in transmitting a driving signal from a control portion 56 (see FIG. 3) of a main body of the printer 1 toward the recording head 10 is placed between the main body of the printer 1 and the recording head 10.

A home position being a scan starting point of the recording head 10 is set within a movable range of the recording head 10 and outside the platen 3. A capping mechanism 12 (corresponding to a sealing section according to some aspects of the invention) is disposed at the home position. The capping mechanism 12 seals a nozzle-formed surface 32*a* (see FIG. 2) of the recording head 10 using a suction cap member 12' to prevent ink solvent from evaporating from a nozzle aperture 35. The capping mechanism 12 is used in a cleaning process described below for removing thickened ink or bubbles entrained in ink by providing the nozzle surface in a sealed state with a negative pressure and forcefully sucking and expelling ink through the nozzle aperture 35. The suction cap member 12' is used as an ink receiver for receiving ink droplets in a flushing process described below for expelling (removing) thickened ink or bubbles entrained in ink by discharging ink droplets without recording information on paper.

Figure 2:
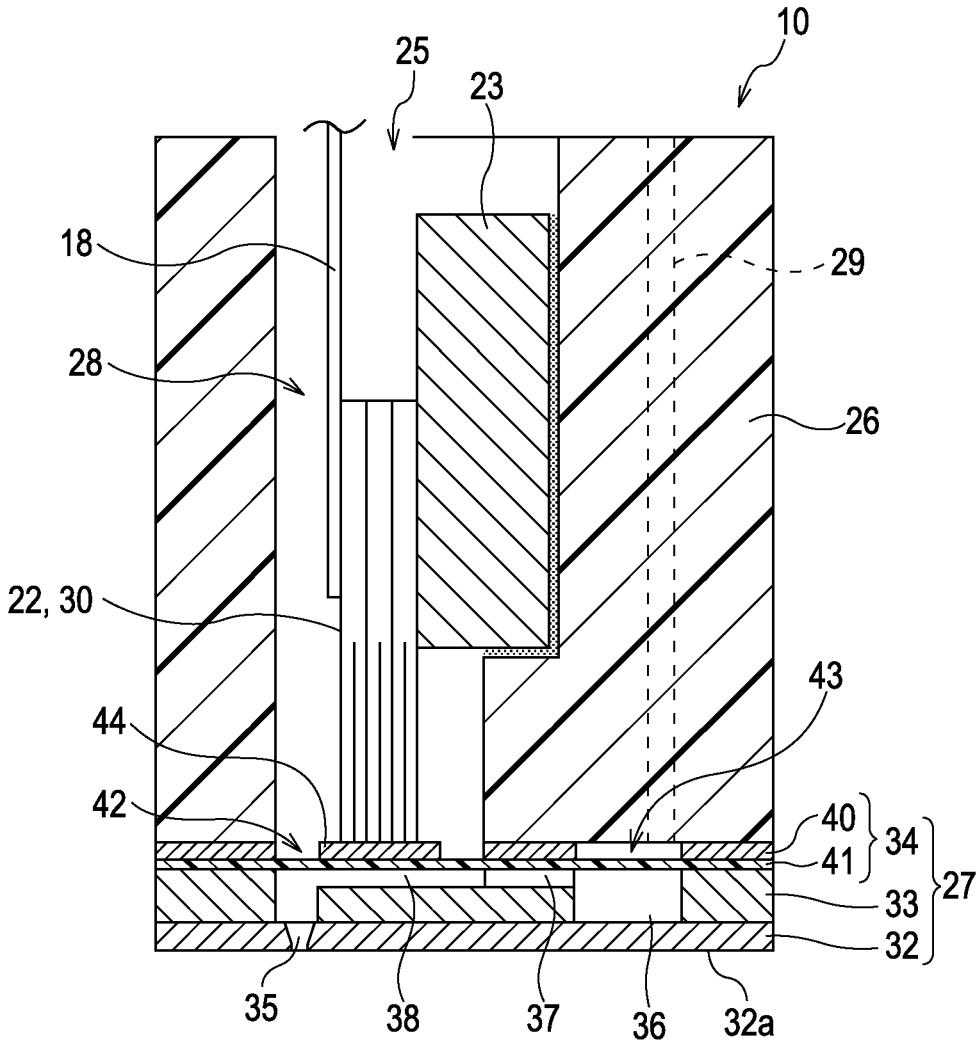
FIG. 2 is a cross-sectional view of a main portion of a recording head.

FIG. 2 is a cross-sectional view of a main portion of the above recording head 10. The recording head 10 according to the present embodiment includes a vibrator unit 25 in which a piezoelectric vibrator set 22, a fixing board 23, and the flexible cable 18 are formed in a unit, a head case 26 capable of accommodating the vibrator unit 25, and a channel unit 27 forming a continuous ink channel (part of a liquid path according to some aspects of the invention) extending from a reservoir (common ink chamber) 36 to the nozzle aperture 35 through a pressure chamber 38.

First, the vibrator unit 25 is described. A piezoelectric vibrator 30 (one kind of a pressure generating section according to some aspects of the invention) included in the piezoelectric vibrator set 22 has a longitudinally slender comb shape divided into significantly narrow portions of the order of several tens of micrometers. The piezoelectric vibrator 30 is configured as a longitudinal vibration piezoelectric vibrator that can longitudinally extend and contract. The piezoelectric vibrators 30 are fixed in a so-called cantilever state at which fixed ends are coupled onto the fixing board 23 and free ends project outwardly beyond an edge of the fixing board 23. An edge of the free end of each of the piezoelectric vibrators 30 is coupled to an island portion 44 forming a diaphragm portion 42 in the channel unit 27, as described below. The flexible cable 18 is electrically coupled to the piezoelectric vibrator 30 at a fixing end side opposite to the fixing board 23. The fixing board 23, which supports the piezoelectric vibrators 30, is made of a metal board having stiffness capable of receiving reaction force from the piezoelectric vibrator 30. In the present embodiment, it is made of a stainless steel board having a thickness of the order of 1 mm.

The head case 26 can be a hollow box portion made of epoxy resin, for example, and has an end surface (bottom) on which the channel unit 27 is fixed and an accommodation space 28 formed therein. The accommodation space 28 accommodates the vibrator unit 25 being one kind of an actuator. The head case 26 also has a case channel 29 formed therein and passing therethrough in its height direction. The case channel 29 is a channel for use in supplying ink from the ink cartridge 13 side to the reservoir 36. A protruding influent aperture portion (not illustrated) as an upstream end of each of the case channels 29 is formed on the upper surface of the head case 26. The influent aperture portion is connected to the ink supply tube 17.

Next, the channel unit 27 is described. The channel unit 27 includes a nozzle plate 32, a channel forming substrate 33, and a vibrating board 34. The nozzle plate 32 is disposed on a first surface of the channel forming substrate 33, the vibrating board 34 is disposed on a second surface of the channel forming substrate 33 opposite to the nozzle plate 32, and they are integrally formed by adhesive or other material.

The nozzle plate 32 is a thin stainless-steel plate that has the plurality of nozzle apertures 35 aligned at a pitch corresponding to a dot forming density. In the present embodiment, for example, the nozzle plate 32 has two laterally arranged nozzle rows, each nozzle row having 180 nozzle apertures 35.

The channel forming substrate 33 is a board member that forms the continuous ink channel (corresponding to part of a liquid path according to some aspects of the invention) made up of the reservoir 36, an ink supply port 37, and the pressure chamber 38. Specifically, the channel forming substrate 33 is a board member in which partitioned spaces serving as the pressure chambers 38 corresponding to the respective nozzle apertures 35 are formed and spaces serving as the ink supply port 37 and the reservoir 36 are formed. The channel forming substrate 33 according to the present embodiment is made by an etching process performed on a silicon wafer. The above pressure chamber 38 is formed as an elongated chamber extending in a direction substantially perpendicular to the direction in which the nozzle apertures 35 are arranged in a row (nozzle row direction). The ink supply port 37 is formed as a narrow portion that has a narrow channel width and that is connected between the pressure chamber 38 and the reservoir 36. The reservoir 36 is a chamber for supplying ink stored in the ink cartridge 13 to the pressure chambers 38 and communicates with the corresponding pressure chambers 38 through the ink supply port 37. In such a way, in the present embodiment, a continuous ink channel extending from an ink channel in the ink supply tube 17 connected to the ink cartridge 13 to the nozzle aperture 35 functions as a liquid path according to some aspects of the invention.

The vibrating board 34 is a dual-structure composite board in which a resin film 41 made of, for example, poly(p-phenylene sulfide) (PPS) is laminated on a support board 40 made of metal, such as stainless steel, and is also a member in which the diaphragm portion 42 for causing the volume of the pressure chamber 38 to fluctuate by sealing a first aperture surface of the pressure chamber 38 and a compliance portion 43 sealing a first aperture surface of the reservoir 36 are formed. The diaphragm portion 42 is configured by an etching process performed on a portion of the support board 40 corresponding to the pressure chamber 38 so as to annularly remove that portion to form the island portion 44 to which the edge of the free end of the piezoelectric vibrator 30 is to be coupled. The island portion 44 has a block shape that is elongated along a direction substantially perpendicular to the direction in which the nozzle apertures 35 are arranged in a row, similar to the two-dimensional shape of the pressure chamber 38. The resin film 41 around the island portion 44 functions as an elastic film. Only the resin film 41 is a portion functioning as the compliance portion 43, that is, a portion corresponding to the reservoir 36 because the support board 40 in that region is removed by an etching process so as to have a shape that resembles the aperture shape of the reservoir 36.

The above island portion 44 is coupled to the edge surface of the piezoelectric vibrator 30, so the volume of the pressure chamber 38 can fluctuate by extension and contraction of the free end of the piezoelectric vibrator 30. With these fluctuations in volume, pressure fluctuations occur in ink within the pressure chamber 38. The recording head 10 is configured to discharge ink droplets through the nozzle aperture 35 using the pressure fluctuations.

Next, an electrical configuration of the printer 1 is described.

Figure 3:
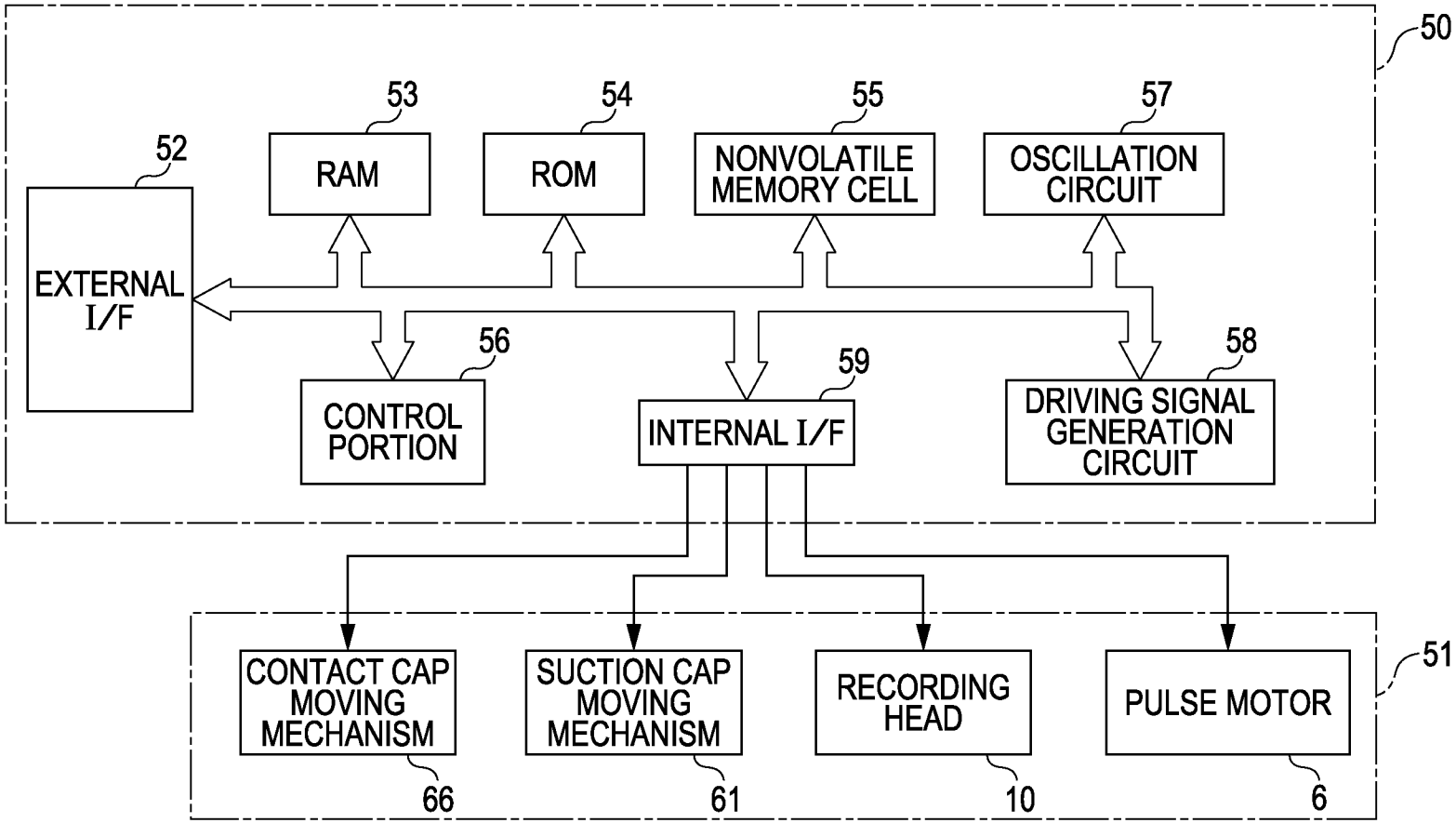
FIG. 3 is a block diagram for describing an electrical configuration of the printer.

FIG. 3 is a block diagram that illustrates an electrical configuration of the printer 1. The printer 1 according to the present embodiment is generally composed of a printer controller 50 and a print engine 51. The printer controller 50 includes an external interface (external I/F) 52 for receiving print data and the like from an external apparatus, such as a host computer, a random-access memory (RAM) 53 for storing various kinds of data, a read-only memory (ROM) 54 storing a control program and the like for use in various kind of control, a nonvolatile storage cell 55 made of an electrically erasable program ROM (EEPROM), a flash ROM, or other components, a control portion 56 (corresponding to a drive control section according to some aspects of the invention) that exercises control over each portion in accordance with a control program stored in the ROM 54, an oscillation circuit 57 that generates a clock signal, a driving signal generation circuit 58 (one kind of a driving signal generating section) that generates a driving signal COM to be supplied to the recording head 10, and an internal interface (internal I/F) 59 for outputting dot pattern data obtained by developing print data per dot, a driving signal, and the like to the recording head 10. The print engine 51 includes the recording head 10, the pulse motor 6, a suction cap moving mechanism 61, and a contact cap moving mechanism 66.

The above control portion 56 controls discharging of ink droplets by the recording head 10 and also controls other portions of the printer 1 in accordance with an operating program stored in the ROM 54. The control portion 56 converts print data input from an external apparatus through the external I/F 52 into discharge data for use in discharging ink droplets by the recording head 10. The discharge data after conversion is transferred to the recording head 10 through the internal I/F 59. A supply of a driving signal COM to the piezoelectric vibrator 30 is controlled on the basis of that discharge data, and the recording head 10 discharges ink droplets, that is, carries out a recording operation (discharging operation).

Figure 4A:
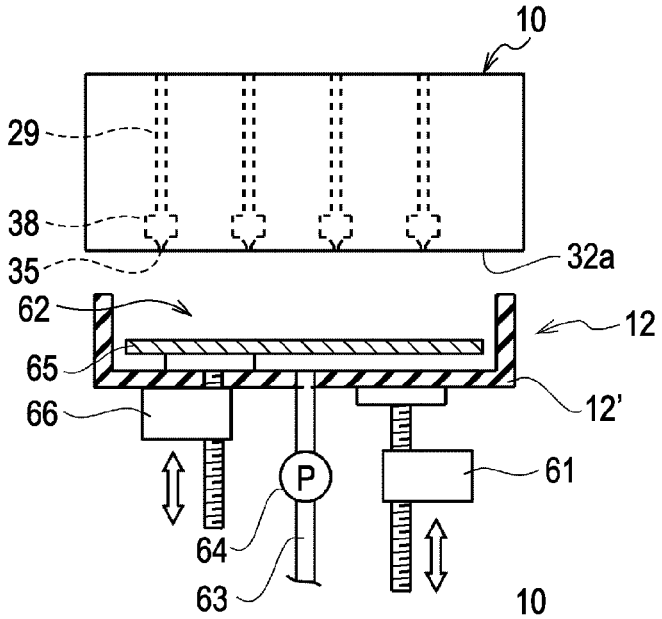
FIGS. 4A to 4C are cross-sectional views for describing a capping mechanism.
Figure 4B:
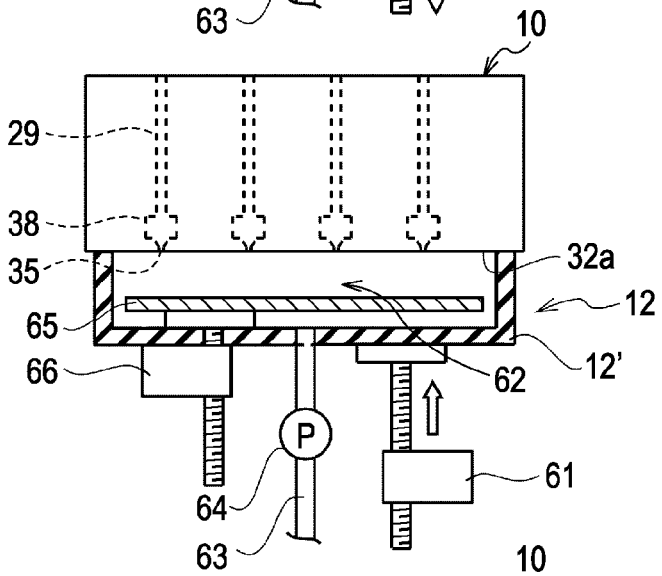
Figure 4C:
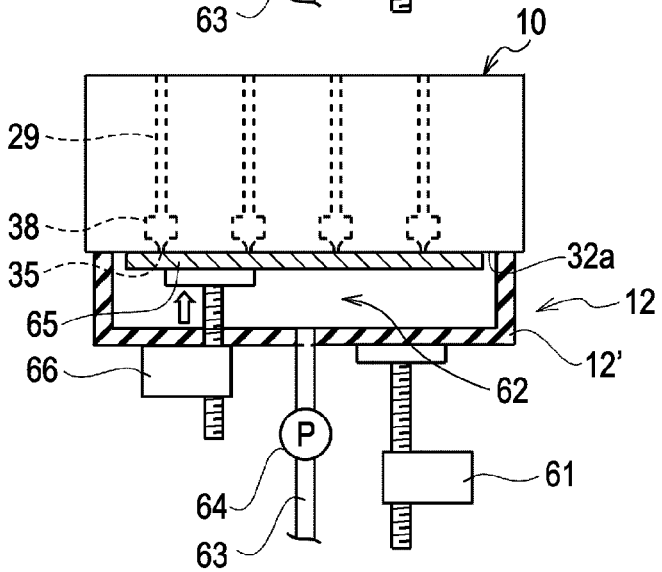

Next, the capping mechanism 12 is described. FIGS. 4A to 4C are cross-sectional views for describing a configuration of the capping mechanism 12; FIG. 4A illustrates a state where the recording head 10 and the capping mechanism 12 are spaced away from each other and face each other; FIG. 4B illustrates a state in a cleaning process; and FIG. 4C illustrates a state in a flushing process. As illustrated in FIG. 4A, the capping mechanism 12 includes the tray suction cap member 12', the suction cap moving mechanism 61 for moving the suction cap member 12' in a direction that approaches to or departs from the nozzle-formed surface 32*a* of the recording head 10, a flexible drain tube 63 connected between a sealing space 62 and a drain tank (not illustrated), and a pump 64 arranged at a point of the drain tube 63.

The above suction cap member 12' is an open upper-surface tray member having a bottom and a side wall rising from the edges of the bottom. A space surrounded by the bottom and the side wall is the sealing space 62. The suction cap member 12' is made of an elastic member, such as rubber or an elastomer. In the sealing space 62, a liquid sucking member (not illustrated) made of a liquid sucking material capable of sucking ink, such as felt or sponge, is placed. The bottom of the suction cap member 12' has a through hole to which the drain tube 63 is coupled in a fluid-tight state.

The above drain tube 63 is a member forming an ink outlet path. In the present embodiment, the drain tube 63 is an elastic silicon tube having high chemical resistance. The pump 64, which is arranged at a point of the drain tube 63, and a driving motor form a pump mechanism. The pump mechanism according to the present embodiment employs a paper feed motor as the driving motor for driving the pump 64. That is, paper feeding or suction controlling is selected by a clutch (not illustrated). Alternatively, a motor dedicated solely to driving the pump 64 may be independently disposed as the driving motor.

Next, a cleaning process and a flushing process performed by the capping mechanism 12 having the above configuration are described. For the printer 1 according to some aspects of the invention, when a normal print mode at which text or images are printed on a recording medium is switched to a cleaning mode at which the cleaning process is performed or a flushing mode at which a flushing process is performed, the recording head 10 is moved to the home position side such that the nozzle-formed surface 32*a* of the recording head 10 and the open upper-surface of the suction cap member 12' of the capping mechanism 12 face each other, as illustrated in FIG. 4A.

In the cleaning process, as illustrated in FIG. 4B, the nozzle-formed surface 32*a* of the recording head 10 is sealed by the suction cap moving mechanism 61, which is made of, for example, a solenoid, upwardly moving the suction cap member 12'. In this sealed state, the nozzle apertures 35 at the nozzle-formed surface 32*a* face the sealing space 62 while the leading end of the suction cap member 12' and the nozzle-formed surface 32*a* are in close contact with each other in a fluid-tight state. In this sealed state, when the pump 64 is actuated, the pressure of the sealing space 62 is reduced, so ink within the recording head 10 can be sucked through the nozzle apertures 35 and the ink can be expelled outside the head. The use of this enables initial filling of filling the ink channel of the recording head 10 with ink from the ink cartridge 13 when the ink cartridge 13 is attached or the above suction control in the cleaning process for removing thickened ink or bubbles in the ink channel.

The above capping mechanism 12 further includes a contact cap member 65 formed from an elastic board made of, for example, rubber and the contact cap moving mechanism 66 for moving the contact cap member 65 in a direction that approaches to or departs from the nozzle-formed surface 32*a* of the recording head 10. The contact cap member 65 is formed so as to have a size that can be accommodated in the sealing space 62 of the suction cap member 12' and that allows at least all the nozzle apertures 35 at the nozzle-formed surface 32*a* to be sealed. When no flushing process is performed, as illustrated in FIGS. 4A and 4B, the contact cap member 65 is retracted at a location adjacent to the bottom of the sealing space 62. Accordingly, in this state, when the nozzle-formed surface 32*a* is sealed by the suction cap member 12', the contact cap member 65 does not come into contact with the nozzle-formed surface 32*a*. In contrast, in the flushing process, as illustrated in FIG. 4C, the capping mechanism 12 moves upward the contact cap member 65 using the contact cap moving mechanism 66, which is made of, for example, a solenoid, thereby causing the raised contact cap member 65 to come into close contact with the nozzle apertures 35 at the nozzle-formed surface 32*a* and sealing the nozzle apertures 35. Then, in this contact sealed state, bobble removal driving pulses DP are successively supplied to the piezoelectric vibrator 30 at intervals T described below.

Figure 5:
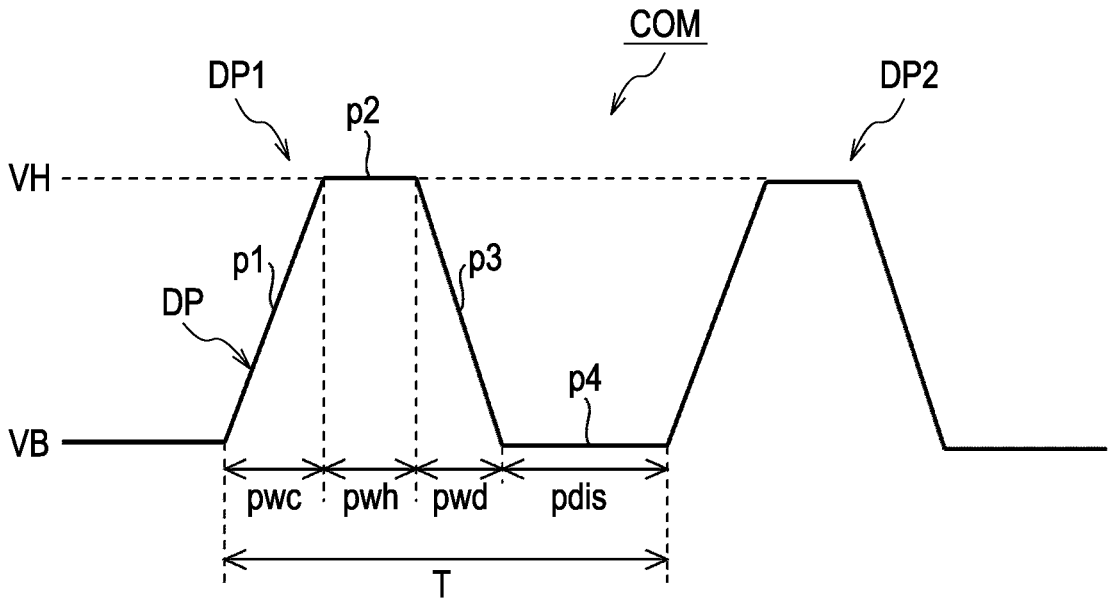
FIG. 5 is a waveform diagram for describing a configuration of a bubble removal driving pulse.

FIG. 5 is a waveform diagram for describing a configuration of a bubble removal driving pulse DP being one of driving signals generated by the driving signal generation circuit 58 having the above configuration. The above-described control portion 56 can generate a driving signal COM containing the bubble removal driving pulses DP for controlling the driving of the piezoelectric vibrator 30. Each of the bubble removal driving pulses DP illustrated in FIG. 5 is a driving pulse for removing bubbles within the liquid channel by causing pressure fluctuations within the pressure chamber 38. The bubble removal driving pulse DP is set so as to cause pressure fluctuations in the ink within the pressure chamber 38 that are larger than those caused by a discharge driving pulse for discharging ink through the nozzle apertures 35 to record images or other information on a recording medium. The driving signal generation circuit 58 successively generates the above bubble removal driving pulses DP at the intervals T. In the flushing process, repeating expansion and contraction of the pressure chamber 38 using the bubble removal driving pulses DP facilitates bubbles subjected to the pressure fluctuations to be dissolved into ink. As a result, after the flushing process, the bubbles can be expelled together with ink through the nozzle apertures 35 in a recording operation, cleaning operation, or other operations.

As illustrated in FIG. 5, the bubble removal driving pulse DP for use in the flushing process according to the present embodiment is a trapezoidal pulse signal and is made up of first to fourth pulse elements p1 to p4. The first pulse element p1 raises potential from reference potential VB to highest potential VH at a constant inclination during a duration pwc. The second pulse element p2 holds the highest potential VH, which is the rear-end potential of the first pulse element p1, for a given length of time (duration pwh). The third pulse element p3 lowers potential from the highest potential VH at a constant inclination during a duration pwd. The fourth pulse element p4 holds the reference voltage VB, which is the rear-end potential of the third pulse element p3, for a given length of time (duration pdis).

Figure 6:
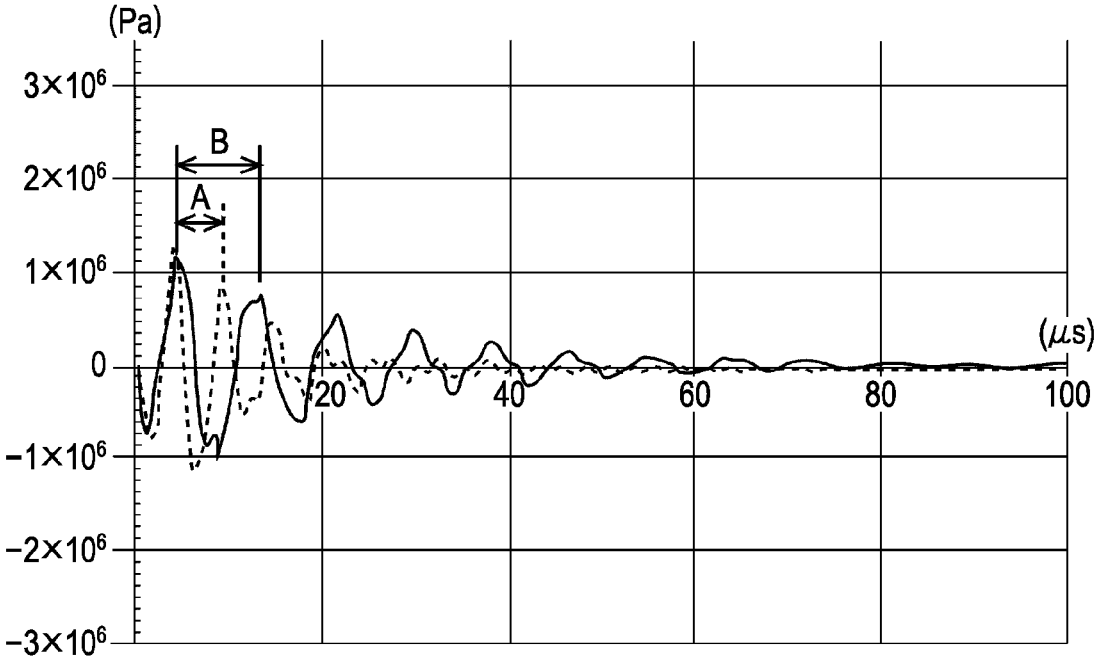
FIG. 6 is a graph that illustrates pressure fluctuations within a pressure chamber caused by a bubble removal driving pulse.

FIG. 6 is a graph that illustrates a result of experiment (simulation) on pressure fluctuations within the pressure chamber 38 when the piezoelectric vibrator 30 is driven by the use of the bubble removal driving pulses DP. In the graph, the horizontal axis denotes time [μs] and the vertical axis denotes pressure [Pa]. In a state where the nozzle apertures 35 are opened, when the bubble removal driving pulses DP in which frequency f of occurrence is set at approximately 1 kHz are supplied to the piezoelectric vibrator 30, as indicated by the broken lines in FIG. 6, ink within the pressure chamber 38 oscillates at a natural oscillation period Tc of approximately 6.8 μs (indicated by the letter "A" in FIG. 6). More specifically, when the first pulse element p1 is supplied to the piezoelectric vibrator 30, the piezoelectric vibrator 30 contracts. With this contraction, the pressure chamber 38 expands from the reference volume corresponding to the reference potential VB to the maximum volume corresponding to the highest potential VH. This causes a negative pressure to occur within the pressure chamber 38, thus bringing the free surface (meniscus) of ink exposed to the nozzle apertures 35 into the pressure chamber 38. The expansion state of the pressure chamber 38 is held constant over a period of supplying the second pulse element p2.

When, subsequent to the second pulse element p2, the third pulse element p3 is supplied to the piezoelectric vibrator 30, the piezoelectric vibrator 30 extends. With this extension, the pressure chamber 38 contracts from the above maximum volume to the reference volume corresponding to the reference potential VB and returns. This contraction of the pressure chamber 38 applies pressure to the ink within the pressure chamber 38 (by the order of 10 atmospheres), thus discharging ink of approximately several picoliters to several tens of picoleters through the nozzle apertures 35.

In contrast, in a contact sealed state where the nozzle apertures 35 are sealed by the contact cap member 65 being in close contact therewith, as indicated by the solid lines in FIG. 6, the ink within the pressure chamber 38 oscillates at a natural oscillation period Tc of approximately 8.5 μs (indicated by the letter B in FIG. 6). This experimental result reveals that, in the case where the nozzle apertures 35 are in a contact sealed state, in comparison with the state where the nozzle apertures 35 are opened, the natural oscillation period Tc within the pressure chamber 38 extends virtually without change in an amplitude range of pressure fluctuations within the pressure chamber 38 when the bubble removal driving pulses DP are supplied to the piezoelectric vibrator 30. More specifically, when the first pulse element p1 is supplied to the piezoelectric vibrator 30, the piezoelectric vibrator 30 contracts. With this contraction, the pressure chamber 38 expands from the reference volume corresponding to the reference potential VB to the maximum volume corresponding to the highest potential VH. This generates a negative pressure larger than that occurring when the nozzle apertures 35 are opened within the pressure chamber 38. The expansion state of the pressure chamber 38 is held constant over a period of supplying the second pulse element p2.

When, subsequent to the second pulse element p2, the third pulse element p3 is supplied to the piezoelectric vibrator 30, the piezoelectric vibrator 30 extends. With this extension, the pressure chamber 38 contracts from the above maximum volume to the reference volume corresponding to the reference potential VB and returns. This contraction of the pressure chamber 38 applies pressure to the ink within the pressure chamber 38, thus causing pressure fluctuations larger than those occurring when the nozzle apertures 35 are opened to occur within the pressure chamber 38 without discharge of ink through the nozzle apertures 35. Accordingly, the pressure fluctuations within the pressure chamber 38 per cycle of the natural oscillation period Tc can be larger than those occurring when the nozzle apertures 35 are opened.

The above natural oscillation period Tc is a value determined by the shape of each of the nozzle apertures 35 and the pressure chamber 38 or the like. The natural oscillation period Tc within the pressure chamber 38 can be represented by the following expression (2), as described in, for example, JP-A-7-285222.

$$Tc=2\pi\sqrt{\{[(Mn\times Ms)/(Mn+Ms)]\times Cc\}} \quad (2)$$

where Mn is inertance in the nozzle aperture 35, Ms is inertance in the ink supply port 37 communicating with the pressure chamber 38, and Cc is compliance (a volume change per unit pressure; it indicates the degree of flexibility). In the above expression (2), the inertance M is the easiness of moving ink in an ink channel and the mass of ink per unit cross section. When the density of ink is ρ, the cross-sectional area of a surface of the channel that is substantially perpendicular to a direction in which ink flows is S, and the length of the channel is L, the inertance M can be approximated by the following expression (3).

$$\text{Inertance } M=(\text{Density } \rho\times\text{Length L})/\text{Cross-sectional Area } S \quad (3)$$

Tc is not limited to the expression (2); it can have any value as long as it is an oscillation period of the pressure chamber 38.

Figure 7:
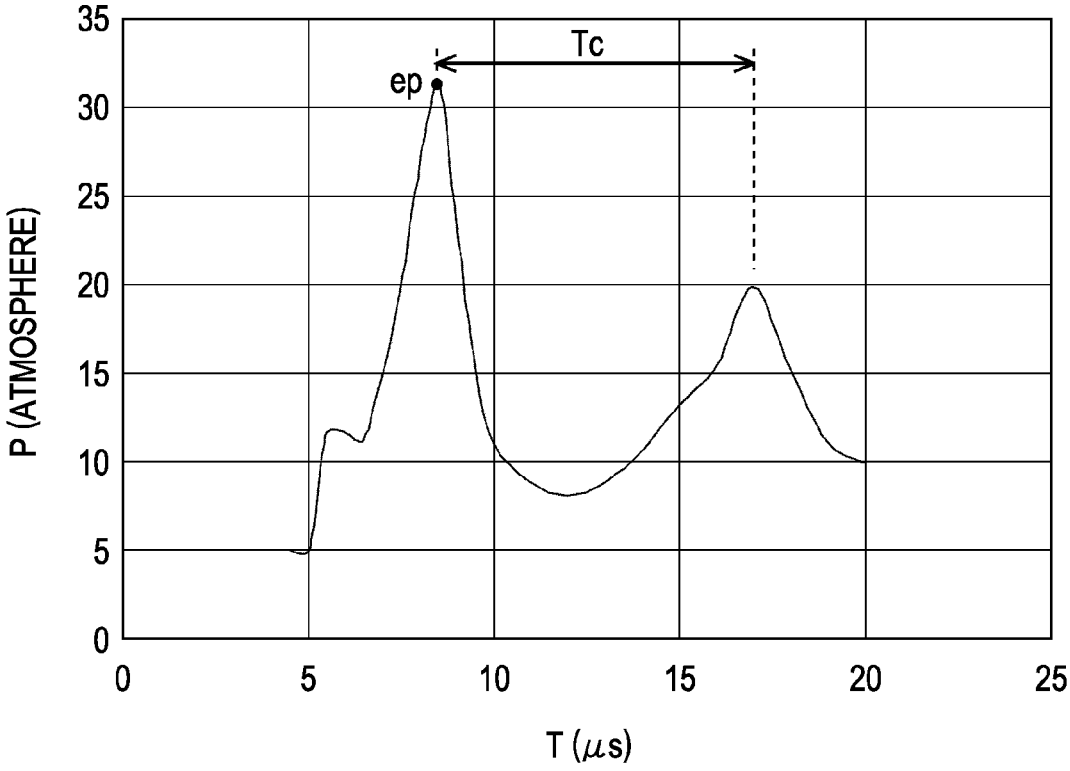
FIG. 7 is a graph that illustrates pressure fluctuations within the pressure chamber caused by a bubble removal driving pulse generated at a different interval.

FIG. 7 is a graph that illustrates pressure fluctuations within the pressure chamber 38 when the generation interval T of bubble removal driving pulses DP, that is, the interval T between the bubble removal driving pulses DP illustrated in FIG. 5 is changed in a contact sealed state of the nozzle apertures 35. In the graph, the horizontal axis denotes time [μs], and the vertical axis denotes pressure [atmosphere].

In addition, the generation interval T of bubble removal driving pulses DP to the piezoelectric vibrator 30 according to some aspects of the invention is set in the range represented by the following expression. n=1, 2, 3 . . . (a natural number).

$$(n-1/4)Tc<T<(n+1/4)Tc \quad (1)$$

For example, when the bubble removal driving pulses DP in which the generation interval T between the bubble removal driving pulse DP1, which first occurs, and the bubble removal driving pulse DP2, which occurs after the bubble removal driving pulse DP1, is set in the range represented by the above expression (1) are successively supplied to the piezoelectric vibrator 30, the pressure fluctuations within the pressure chamber 38 caused by the bubble removal driving pulses DP and the natural oscillation period Tc within the pressure chamber 38 can resonate with each other, and the maximum value of a positive pressure in the pressure fluctuations within the pressure chamber 38 (indicated by the characters ep in FIG. 7) can be increased to 30 atmospheres or above. That is, the amplitude of the pressure fluctuations within the pressure chamber 38 can be increased approximately three times that occurring when the pressure fluctuations are caused by supplying the bubble removal driving pulse DP of one cycle to the piezoelectric vibrator 30 alone.

Figure 8:
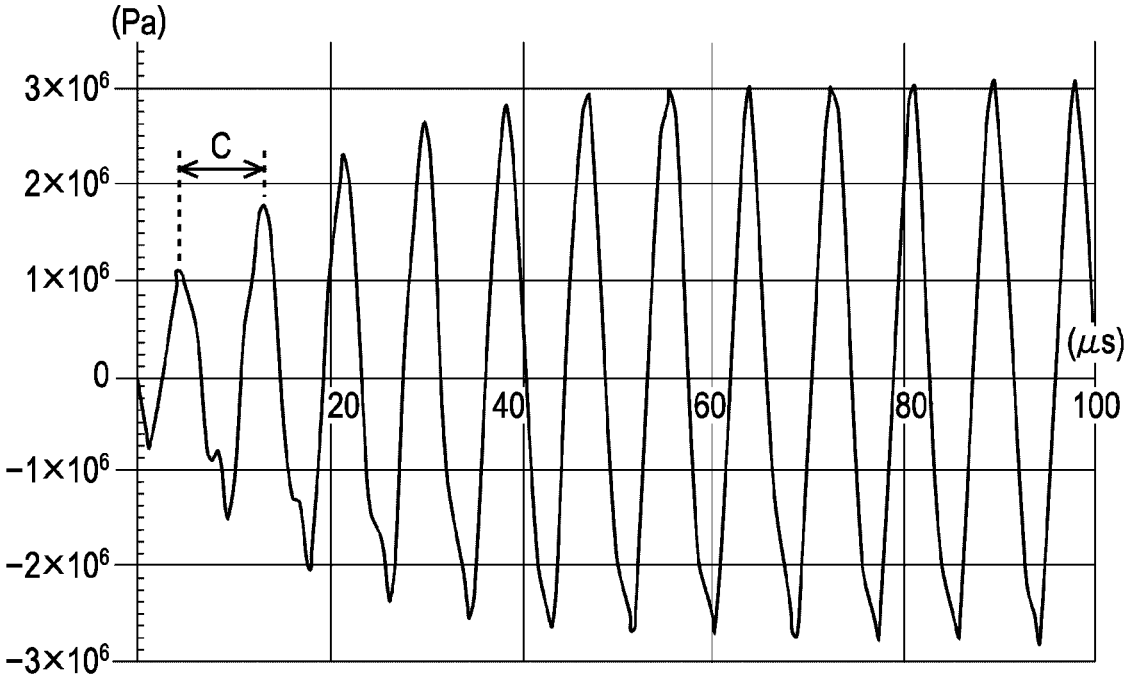
FIG. 8 is a graph that illustrates pressure fluctuations within the pressure chamber caused by a bubble removal driving pulse generated at another different interval.

FIG. 8 is a graph that illustrates pressure fluctuations in the pressure chamber caused by bubble removal driving pulses at further another generation interval. When bubble removal driving pulses DP in which the frequency f of occurrence is set at approximately 117.6 kHz are successively supplied to the piezoelectric vibrator 30, as illustrated in FIG. 8, the pressure fluctuations within the pressure chamber 38 caused by the bubble removal driving pulses DP and the natural oscillation period Tc within the pressure chamber 38 can resonate with each other. With this, the ink within the pressure chamber 38 oscillates at a natural oscillation period Tc of approximately 8.5 μs (indicated by the letter C in FIG. 8) while its amplitude increases. That is, the pressure fluctuations within the pressure chamber 38 increased approximately three times those occurring when the pressure fluctuations are caused by supplying the bubble removal driving pulse DP of one cycle alone can be repeatedly generated within the pressure chamber 38, so performance of expelling bubbles can be further enhanced.

As described above, for the printer 1 according to the present embodiment, a driving pulse for driving the piezoelectric vibrator 30 is set so as to cause pressure fluctuations in the ink within the pressure chamber 38 that are larger than those caused by a discharge driving pulse for causing discharge of ink droplets and contains a bubble removal driving pulse DP for causing removal of bubbles within the pressure chamber 38 and a continuous liquid channel including the nozzle aperture 35, and the capping mechanism 12 seals the nozzle apertures 35 of the recording head 10 in driving the piezoelectric vibrator 30 by the bubble removal driving pulses DP, that is, in performing a flushing process, so pressure fluctuations within the pressure chamber 38 caused by supplying the bubble removal driving pulses DP can be larger than those occurring when the nozzle apertures 35 are opened. As a result, the amount of bubbles dissolved in ink in the liquid channel can be increased, and this can enhance expelling performance. Additionally, ink is not discharged through the nozzle openings 35 in supplying the bubble removal driving pulses DP, so unnecessary ink consumption can be reduced.

The pressure fluctuations within the pressure chamber 38 caused by the bubble removal driving pulses DP and the natural oscillation period Tc within the pressure chamber 38 can resonate with each other, so the pressure fluctuations within the pressure chamber 38 can be further increased. As a result, the amount of bubbles dissolved in ink entrained in the liquid channel can be increased, and this can enhance expelling performance.

The check valve 11 allowing ink to flow downstream and restricting upstream backflow of ink is provided upstream from the pressure chamber 38 in the liquid channel, so escape of the pressure fluctuations within the pressure chamber 38 caused by the bubble removal driving pulses DP upstream from the check valve 11 can be restricted. This can further increase the pressure fluctuations within the pressure chamber 38, and performance of expelling bubbles entrained in the liquid channel can be enhanced.

The invention is not limited to the above embodiment, and various modifications can be made on the basis of the scope of claims.

The above embodiment describes an example in which the check valve 11 is provided upstream from the pressure chamber 38 in the liquid channel and restricts upstream backflow of ink. However, the invention is not limited to this example. For example, a flow selector (not illustrated) that can select flow or non-flow of ink, such as an open/close valve, may be provided upstream from the pressure chamber 38 in the liquid channel, and the flow selector may select a non-flow state when the piezoelectric vibrator 30 is driven by the bubble removal driving pulses DP. This can restrict escape of the pressure fluctuations within the pressure chamber 38 caused by the bubble removal driving pulses DP upstream from the flow selector. As a result, the pressure fluctuations within the pressure chamber 38 can be further increased, and performance of expelling bubbles entrained in the liquid channel can be enhanced.

Figure 9:
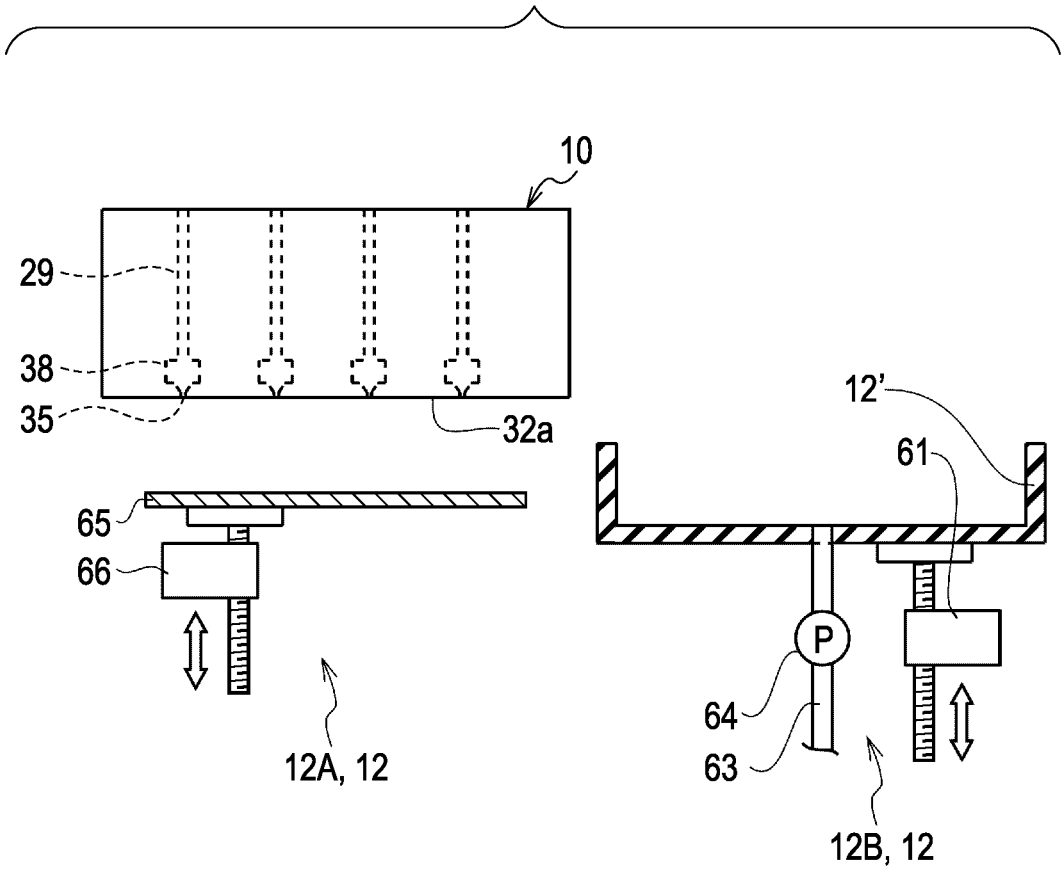
FIG. 9 is a cross-sectional view for describing a cap mechanism according to a second embodiment.

The above embodiment describes the capping mechanism 12 illustrated in FIGS. 4A to 4C as one example of a capping mechanism according to some aspects of the invention. However, the invention is not limited to this example. For example, as illustrated in FIG. 9, the capping mechanism 1 may include separate flushing portion 12A and cleaning portion 12B, the flushing portion 12A having the contact cap member 65 and the contact cap moving mechanism 66, the cleaning portion 12B having the suction cap member 12', the suction cap moving mechanism 61, the drain tube 63, and the pump 64.

In the above embodiment, the bubble removal driving pulse DP illustrated in FIG. 5 is described as one example of a bubble removal driving pulse according to some aspects of the invention. However, the shape of a pulse is not limited to the illustrated example. A pulse having any waveform may be used as long as it is a driving pulse including at least an expansion element (first pulse element p1) for preliminarily expanding the pressure chamber 38, an expansion holding element (second pulse element p2) for holding an expanded state of the pressure chamber 38 for a given length of time, and a discharge element (third pulse element p3) for causing discharge of ink through the nozzle aperture 35 by contraction of the pressure chamber 38.

The above embodiment illustrates an example that uses a so-called longitudinal vibration piezoelectric element as the piezoelectric vibrator 30. However, a piezoelectric element according to some aspects of the invention is not limited to this example. For example, a piezoelectric element operable in flexural vibration mode can be used. The piezoelectric vibrator 30 may be a magnetostrictor or a heating element when ink generating bubbles is used.

Furthermore, a material and structure of each member are not limited to the above embodiment, and various configurations can be used. With a different structure, a bubble removal driving pulse is determined on the basis of Tc in that structure.

In the foregoing, the printer 1 being one kind of a liquid ejecting apparatus is described as an example. However, the invention is also applicable to other liquid ejecting apparatuses. For example, the invention is also applicable to display manufacturing equipment for manufacturing a color filter of a liquid crystal display or other displays, electrode manufacturing equipment for forming an electrode of an organic electroluminescent (EL) display, field emission display (FED) (surface emitting display), or other displays, and chip manufacturing equipment for manufacturing a biochip (biochemical element).

What is claimed is:

1. A liquid ejecting apparatus comprising:

a liquid ejecting head including a continuous liquid path and a pressure generating section, the liquid path containing a pressure space and a nozzle opening, the pressure generating section causing pressure fluctuations to occur in liquid within the pressure space, the liquid ejecting head ejecting droplets through the nozzle opening by driving the pressure generating section;

a driving signal generating section capable of generating a driving signal containing a driving pulse that drives the pressure generating section;

a drive control section that supplies the driving pulse contained in the driving signal generated by the driving signal generating section to the pressure generating section; and a sealing section that seals a nozzle-formed surface of the liquid ejecting head, wherein the driving pulse includes a first pulse for causing discharge of droplets and a second pulse, the second pulse being generated to the pressure generating section at a generation interval T set in a range represented by the following expression:

$$(n-1/4)Tc<T<(n+1/4)Tc$$

where Tc is a natural oscillation period for the liquid within the pressure space and where n=1, 2, 3 . . . (a natural number), and the sealing section seals the nozzle opening of the liquid ejecting head when the pressure generating section is driven by the second pulse.

2. A liquid ejecting apparatus comprising:

a liquid ejecting head including a continuous liquid path and a pressure generating section, the liquid path containing a pressure space and a nozzle opening, the pressure generating section causing pressure fluctuations to occur in liquid within the pressure space, the liquid ejecting head ejecting droplets through the nozzle opening by driving the pressure generating section;

a driving signal generating section capable of generating a driving signal containing a driving pulse that drives the pressure generating section;

a drive control section that supplies the driving pulse contained in the driving signal generated by the driving signal generating section to the pressure generating section; and a sealing section that seals a nozzle-formed surface of the liquid ejecting head, wherein the driving pulse includes a first pulse for causing discharge of droplets and a second pulse that causes pressure fluctuations in the liquid within the pressure space that are larger than pressure fluctuations caused by the first pulse, and the sealing section seals the nozzle opening of the liquid ejecting head when the pressure generating section is driven by the second pulse, wherein the second pulse is generated to the pressure generating section at a generation interval T set in a range represented by the following expression:

$$(n-1/4)Tc<T<(n+1/4)Tc$$

where Tc is a natural oscillation period for the liquid within the pressure space and where n=1, 2, 3 . . . (a natural number).

3. The liquid ejecting apparatus according to claim 1, further comprising:

a backflow restricting section disposed upstream from the pressure space in the liquid path, the backflow restricting section allowing the liquid to flow downstream and restricting an upstream backflow of the liquid.

4. The liquid ejecting apparatus according to claim 1, further comprising:

a flow selecting section disposed upstream from the pressure space in the liquid path, the flow selecting section being capable of selecting flow or non-flow of the liquid, wherein the flow selecting section selects a non-flow state when the pressure generating section is driven by the second pulse.

5. A liquid ejecting apparatus comprising:

a liquid ejecting head including a continuous liquid path and a pressure generating section, the liquid path containing a pressure space and a nozzle opening, the pressure generating section causing pressure fluctuations to occur in liquid within the pressure space, the liquid ejecting head ejecting droplets through the nozzle opening by driving the pressure generating section;

a driving signal generating section capable of generating a driving signal containing a driving pulse that drives the pressure generating section;

a drive control section that supplies the driving pulse contained in the driving signal generated by the driving signal generating section to the pressure generating section; and a sealing section that seals a nozzle-formed surface of the liquid ejecting head, wherein the driving pulse includes a first pulse for causing discharge of droplets and a second pulse, the second pulse causing pressure fluctuations in the liquid within the pressure space that are larger than pressure fluctuations caused by the first pulse and causing removal of bubbles within the liquid path, and the sealing section seals the nozzle opening of the liquid ejecting head when the pressure generating section is driven by the second pulse, wherein the second pulse is generated to the pressure generating section at a generation interval T set in a range represented by the following expression:

$$(n-1/4)Tc<T<(n+1/4)Tc$$

where Tc is a natural oscillation period for the liquid within the pressure space and where n=1, 2, 3 . . . (a natural number).

* * * * *